United States Patent [19]

Gergely

[11] 4,035,975

[45] July 19, 1977

[54] WALL OF BUILDING BLOCKS AND METHOD OF CONSTRUCTING IT

[76] Inventor: Franz Julius Gergely, Durener Str. 98, 5 Cologne 41, Germany

[21] Appl. No.: 658,316

[22] Filed: Feb. 17, 1976

Related U.S. Application Data

[63] Continuation-in-part of Ser. No. 504,604, Sept. 9, 1974, abandoned.

[51] Int. Cl.[2] ..... E04C 2/30; E04C 1/10

[52] U.S. Cl. ..... 52/284; 52/591; 52/594

[58] Field of Search ..... 52/589–594, 52/284, 234

[56] References Cited

U.S. PATENT DOCUMENTS

| | | | |
|---|---|---|---|
| 2,126,012 | 8/1938 | Hedinger | 52/286 |

FOREIGN PATENT DOCUMENTS

| | | | |
|---|---|---|---|
| 512,239 | 1/1921 | France | 52/593 |
| *80,923 | 5/1963 | France | 52/590 |
| 420,434 | 4/1947 | Italy | 52/593 |
| 173,103 | 12/1921 | United Kingdom | 52/234 |

OTHER PUBLICATIONS

*3rd Add. to French Pat. No. 1,240,675.

*Primary Examiner*—Price C. Faw, Jr.
*Assistant Examiner*—James L. Ridgill, Jr.
*Attorney, Agent, or Firm*—Alan H. Levine

[57] ABSTRACT

A wall of building blocks, each block being in the form of a parallelepipedon having corrugated or sawtooth shaped upper and lower surfaces, the corrugations or teeth of one surface extending perpendicular to the corrugations or teeth of the other. Two opposite ends of the block may be provided with parallel ribs and slots in asymmetric relation so that when two such blocks are arranged end-to-end a slot in each block accommodates a rib of the other block. Some blocks may have one flat end and a slot in one of its sides to accommodate the rib of another block when the two blocks are arranged to form a corner. All the blocks have cavities extending completely through them. A plurality of such blocks can be arranged end-to-end and one above the other, with the corrugations or sawteeth of each block meshing with the corrugations or sawteeth of another, to form a wall, and mortar or concrete is then poured into all the aligned cavities of the blocks.

6 Claims, 5 Drawing Figures

WALL OF BUILDING BLOCKS AND METHOD OF CONSTRUCTING IT

This application is a continuation-in-part of copending application Ser. No. 504,604, filed Sept. 9, 1974, now abandoned.

In contrast with known building blocks, this invention shows how to obtain a very simple, rational, fast three-dimensional, method of construction using building blocks of special character.

As occasion demands, this method of construction does not even need more than one single type of building block. The design of the new building block makes it possible to build walls on already existing ones, starting in any desired place, in any direction, and without damaging the already existing wall. In addition, there is no need to provide connecting material, such as mortar, in layers between the course of building blocks, although mortar can be used internally.

A specially constructed parallelepipedon as the basic block, or possible a plurality of them, complies with these requirements.

The lower or upper side of the block has undulations, i.e., is toothed or corrugated. The pattern of the corrugations or teeth on the upper side is at a right angle to the corrugations or teeth on the lower side.

Two opposed ends of the building block have parallel running, vertical slots and ribs in inverse relationship. Thus any side-slipping is prevented. One side of the building blocks has a slot for accommodating the rib projecting from the end of another of the blocks, when the blocks are arranged to form a corner of the structure.

The new building blocks make any layman a qualified bricklayer, as the special formation of the surfaces guarantees brickword with exact vertical and horizontal walls.

The invention can be seen clearly in the accompanying illustrations, which show some examples only and not the multiple possibilities.

Figure 1:
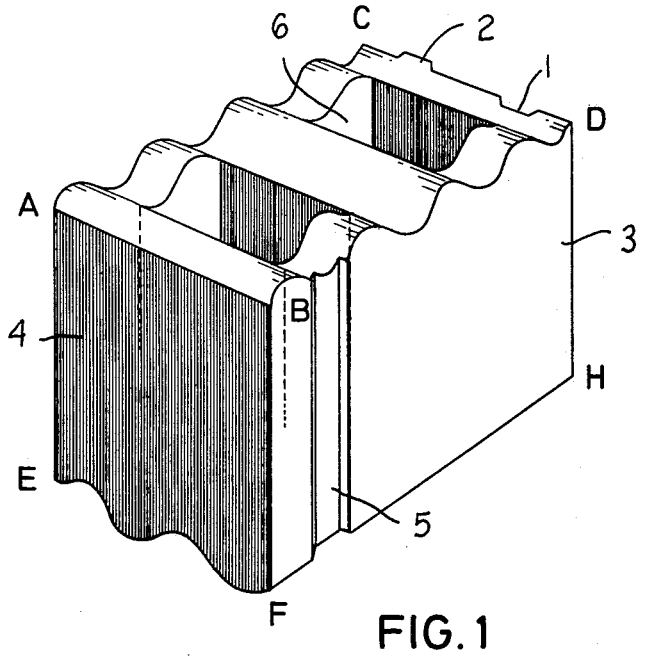
FIGS. 1 and 2 show a possible basic building block having the general shape of a right parallelepipedon.
Figure 2:
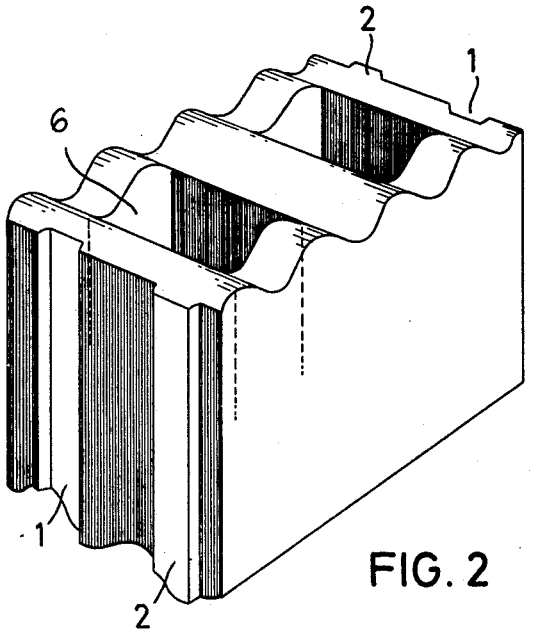

In FIGS. 1 and 2, top (ABCD) and the bottom (EFH) of the block are corrugated in such a way that the parallel vertical section appears as a sine function with the pattern of the corrugation (FIG. 1). The patterns of the corrugations in the top and the bottom, however, are at a right angle to each other. There are twice as many corrugations in the top as in the bottom.

The opposed ends (ABEF + DHC) have parallel running, vertical slots 1 and ribs 2, in inverse relationship (FIG. 2). When two blocks are placed end-to-end, the ribs in the two adjacent end are accommodated by the slots in those ends.

Figure 5:
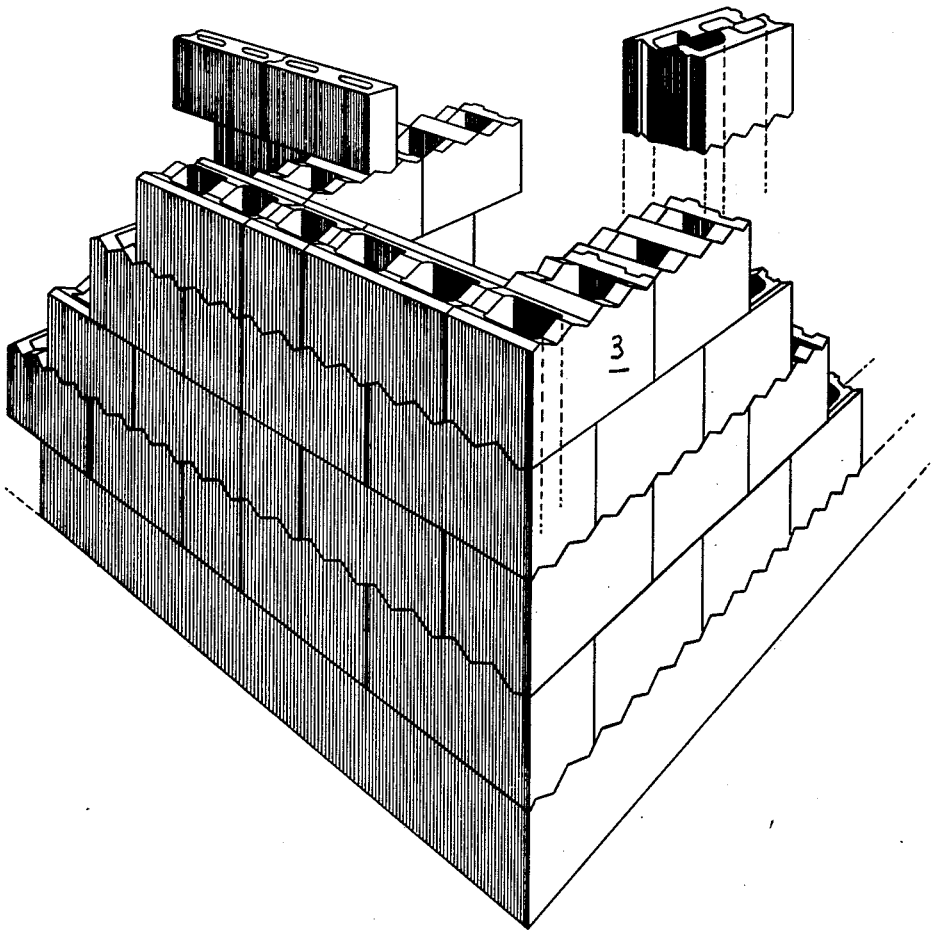
FIG. 5 shows a wall built with basic building blocks.

The block 3 of FIG. 1 has one flat end 4 so that it may be used at the corner of a structure (see FIG. 5). One side of block 3 has a slot 5 for accommodating a rib 2 of another block when block 3 is used to form a corner.

Figure 3:
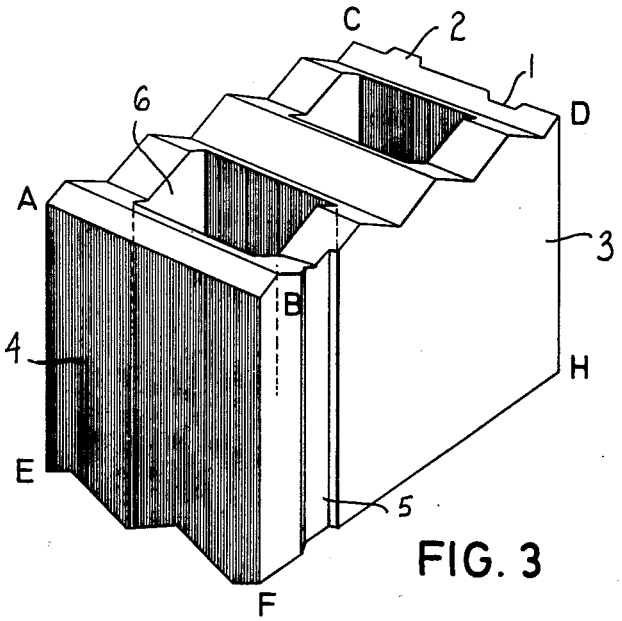
FIG. 3 and FIG. 4 show another basic type of building block.
Figure 4:
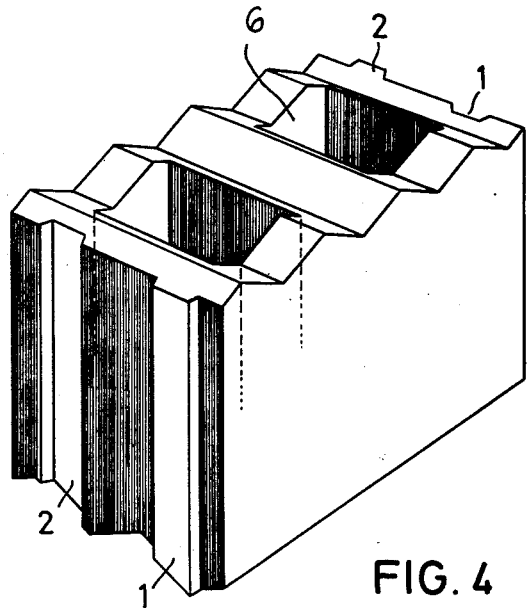

In FIGS. 3 and 4, top and the bottom (ABCD and EFH) of the element are toothed in such a way, that the pattern of the toothed and the parallel running, vertical section has the form of sawteeth (FIG. 3). The pattern of the teeth on the top and bottom, however, are at a right angle to each other.

The lines forming the sawteeth correspond with the lines connecting the maxima with the minima of the side function by the inflexus point (FIG. 3).

Two opposed ends (ABEF and DHC) are provided with parallel running vertical slots 1 and ribs 2, in inverse relationship (FIG. 4). The block 3 of FIG. 3 has one flat end 4, and one side of that block has a slot 5 for accommodating a rib 2 of another block.

In FIG. 5, it can be seen that various elements can be used, always interconnected with each other. The contour of the undulations are identical so that the bottom undulations of each block mesh with the top undulations of another block.

This structure renders possible fast and easy building of walls and corners. Furthermore the building of vertical walls in all directions is possible, as well as openings for doors and windows. The building blocks can be made from any materials, such as brick, sand-lime brick, clay concrete, light concrete, wood, plastics, glass, metal, boards, etc., as well as combinations of these materials.

As the structural elements can be provided with through cavities 6, the installation of cables, tubes, etc. is no problem.

An invisible reinforcement, made with normal materials, can be provided in certain cases. Specifically, the vertically aligned cavities 6 in a wall made of the building blocks can be filled with a bonding material, such as mortar or concrete, to solidly join the blocks together. Smaller sizes of these blocks can even be used for model, or playthings, constructions.

It should also be mentioned that the blocks can be used for pruposes of the interior architecture.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A wall composed of building blocks arranged end-to-end and one above the other, each building block having the general shape of a right parallelepipedon including including front and rear sides, two ends, a top, and a bottom, said top being formed with continuous undulations each of which extends in a direction from said front side toward said rear side, said bottom being formed with continuous undulations each of which extend in a direction perpendicular to said top undulations, the contour of all said undulations being identical so that the bottom undulations of the block can mesh with the top undulations of another similar block, there being twice as many top undulations as bottom undulations on said block, each end of the block presenting a slot and a rib extending between said top and bottom, said slot and rib on each end being in positions reversed with respect to the slot and rib on the opposite end so that when two such blocks are placed end-to-end, the ribs in the two adjacent ends are accommodated by the slots in those ends, and at least some of said blocks having slots in their sides for accommodating the rib presented by the end of another block when two blocks are arranged perpendicular to each other to form a corner of the wall.

2. A wall as defined in claim 1 wherein said undulations of each block have the shape of a sine wave.

3. A wall as defined in claim 1 wherein said undulations of each block have a sawtooth shape.

4. A wall as defined in claim 1 wherein said front and rear sides of each block are flat.

5. A wall as defined in claim 1 wherein the blocks are made of a material selected from the group consisting of brick, clay, concrete, wood, plastic, glass, metal, and combinations thereof.

6. A wall as defined in claim 1 wherein said bonding material is one of mortar and concrete.

* * * * *